US006481303B1

(12) United States Patent
Tsuruta et al.

(10) Patent No.: US 6,481,303 B1
(45) Date of Patent: Nov. 19, 2002

(54) CRANK PULLEY FOR RECOIL STARTER

(75) Inventors: Toshio Tsuruta, Saitama (JP); Masayuki Murakami, Saitama (JP)

(73) Assignee: Showakiki Industry Co., Ltd., Saitama (JP)

( * ) Notice: Subject to any disclaimer, the term of this patent is extended or adjusted under 35 U.S.C. 154(b) by 0 days.

(21) Appl. No.: 09/489,337

(22) Filed: Jan. 21, 2000

(51) Int. Cl.[7] ..... F02N 1/00
(52) U.S. Cl. ..... 74/6; 123/185.3
(58) Field of Search ..... 74/6; 123/185.14, 123/185.2, 185.3; 192/42, 69.7, 108

(56) References Cited

U.S. PATENT DOCUMENTS 4,480,605 A * 11/1984 Bloemers ..... 123/185 BA
5,715,783 A * 2/1998 Osakabe et al. ..... 123/185.3
6,167,858 B1 * 1/2001 Murakami ..... 123/185.3

FOREIGN PATENT DOCUMENTS

JP 10-281043 * 10/1998
JP 2000-45916 * 2/2000

* cited by examiner

*Primary Examiner*—David Fenstermacher
(74) *Attorney, Agent, or Firm*—Armstrong, Westerman & Hattori, LLP

(57) ABSTRACT

A crank pulley for a recoil starter which integrally comprising a plate body, a leg portion perpendicular to the plate body and an impact surface formed on the leg portion.

16 Claims, 13 Drawing Sheets

PRIOR ART

PRIOR ART

CRANK PULLEY FOR RECOIL STARTER

BACKGROUND OF THE INVENTION

1. Field of the Invention

The present invention relates to a crank pulley for recoil starter and more particularly to a crank pulley for recoil starter fitted to an engine crankshaft so as to meet a recoil-starter provided with a dog which moves axially or radically to an engine crankshaft when an engine is started, the crank pulley having an impact surface against the dog.

2. Prior Art

There have been various problems in conventional crank pulley for recoil starters of a type in which a dog moves axially to an engine crankshaft when an engine is started while improvement in such conventional pulleys is proposed. For example, the present inventor has developed a crank pulley for recoil starter having a flange 2 on an opening 1 thereof which is provided with an impact surface 3 of a nearly L-shaped cross section integrally formed on the flange 2 in the opposite direction to an engine by cut-and-bend pressing as shown in FIG. 1, which has been applied as Japanese Patent Kokai No. 10-281,043.

The impact surface 3 of the crank pulley should however have enough strength to rotate an engine crankshaft when the impact surface 3 contacts a dog 4 and width enough to exhibit such strength. In order to increase a width of the impact surface 3, it is inevitably necessary to increase width (or diameter) of the flange 2. Although such a crank pulley is more advantageous compared with conventional ones, a flow of cooling air to be introduced to the engine is undesirably controlled because of the increased width of the flange 2.

On the other hand, there is also used a crank pulley having holes for receiving a dog on a cylinder wall thereof as shown in FIGS. 3 and 4, in which the dog moves in the radial direction of a crankshaft.

In order to prepare a crank pulley for recoil-starter of either type in which the dog moves axially or radially to the crankshaft, it is necessary to deep draw a metal plate, which not only tends to cost additionally because of molding and working costs but causes troubles.

SUMMARY OF THE INVENTION

Accordingly, it is an object of the present invention to provide a crank pulley for recoil starter integrally comprising a plate body, a leg portion almost vertically stood up from the plate body, and an impact surface formed on one side of the leg portion and extended almost vertically to the plate body, said crank pulley for recoil starter being fitted to an engine crankshaft so as to meet a recoil-starter provided with a dog which moves axially or radially to an engine crankshaft when an engine is started.

DETAILED DESCRIPTION AND THE PREFERRED EMBODIMENTS

An impact surface of the present crank pulley for recoil starter may either be a side surface itself as one side of a leg portion or a surface formed by extending one side of the leg portion outward.

In the present crank pulley, the top of a leg portion may be inclined downward from the impact surface to the opposite end surface to give a gradient. As a dog often hits on the leg portion other than the impact surface after impactive contact, the gradient mentioned above allows to reduce an impact of the dog and prevent damage thereof.

Further, there may be formed a flange fitted at a right angle to the leg portion and extended outward therefrom. The gradient portion may also be provided with such a flange, thereby forming a slant edge similarly as a cross section of the leg portion and increasing a dog hitting area. An increase in the dog hitting area reduces an impact of the dog and improves durability thereof.

The impact surface may be provided with a dog capturing tool formed by partially protruding the impact surface.

A plate body of the present crank pulley may basically be square, circular or polygonal.

The leg portion may be flat or crosswise bent and be formed plurally depending on numbers of dogs.

The present crank pulley may be used in the either type of recoil-starter in which the-dog moves axially and radially to an engine crankshaft respectively.

It is preferable to integrally form the present crank pulley from a single metal plate by pressing.

It is also preferable to bevel and slightly bend corner portions of the dog impact surface of the crank pulley or an area where the dog might hit so as not to damage the dog.

The present crank pulley for recoil starter allows to improve an introduction of cooling air flow thereto and can be formed without a deep draw process, which enables an easier and low cost production thereof.

EMBODIMENTS

Referring now to the appended drawing, embodiments of the present invention will be further described in detail. In FIGS. 5 to 18, each of portions is designated by numerals corresponding to those numerals used in FIGS. 1 to 4 to designate similar portions of conventional crank pulleys for recoil starter.

The present invention is embodied as will be described in the following but is not restricted by these embodiments. Further, it is to be understood that these embodiments may be modified or combined each other without departing from the spirit and scope of the present invention.

In the following embodiments, each of crank pulleys for recoil starter is formed by pressing a single metal plate of regular thickness. A circular portion perforated in the center of the crank pulley is used to fit an engine crankshaft therein.

Figure 1:
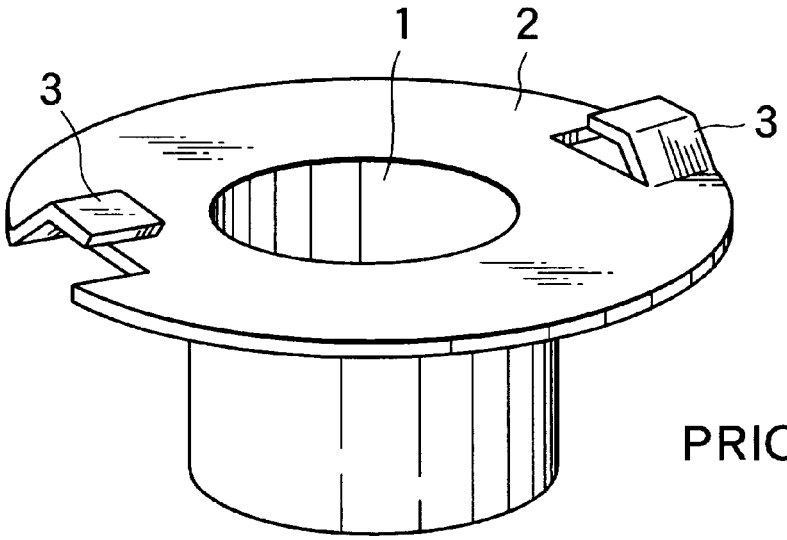
FIG. 1 is a perspective view of a conventional crank pulley for recoil starter.
Figure 2:
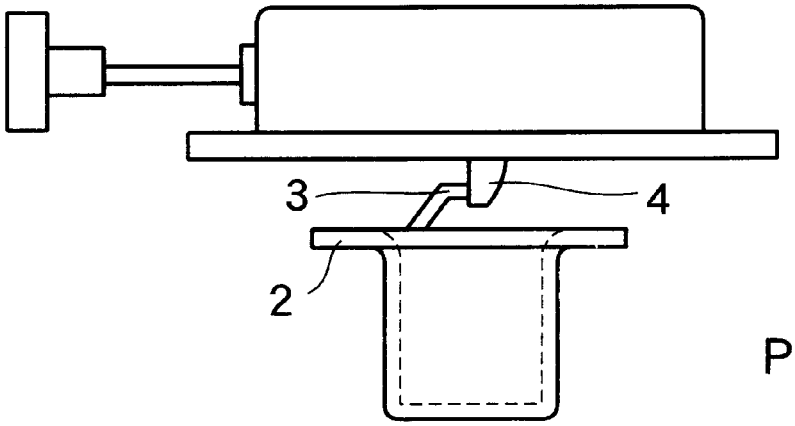
PRIOR ART FIG.2
FIG. 2 is an illustration to show a situation where a crank pulley shown in FIG. 1 contacts a recoil-starting dog.
Figure 3:
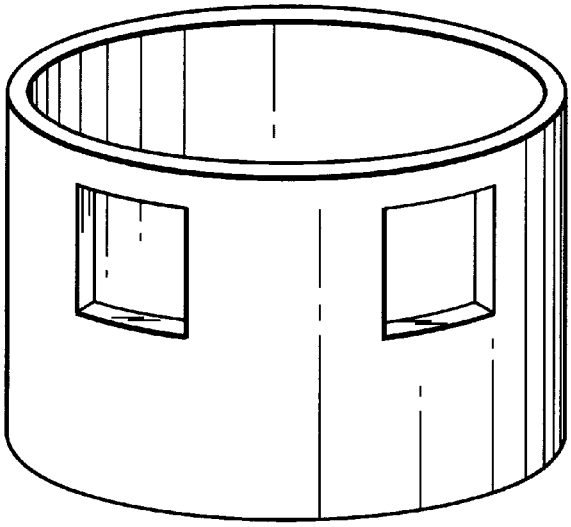
FIG. 3 is a perspective view of another conventional crank pulley for recoil starter.
Figure 4:
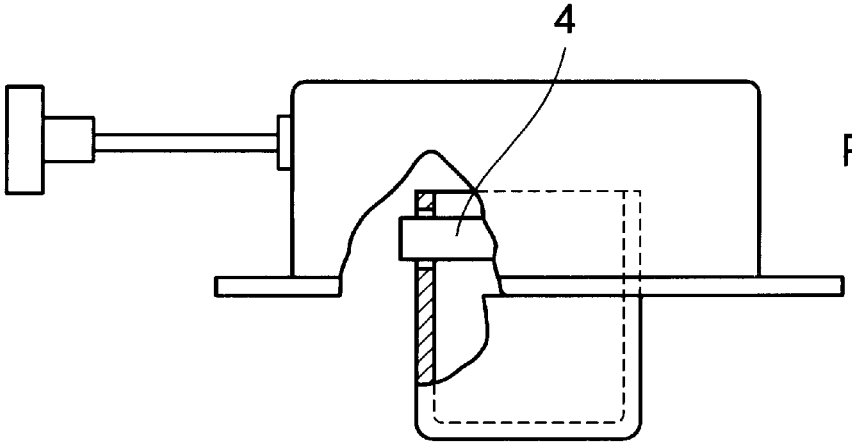
PRIOR ART FIG.4
FIG. 4 is an illustration to show a situation where a crank pulley shown in FIG. 3 contacts a recoil-starting dog.
Figure 5:
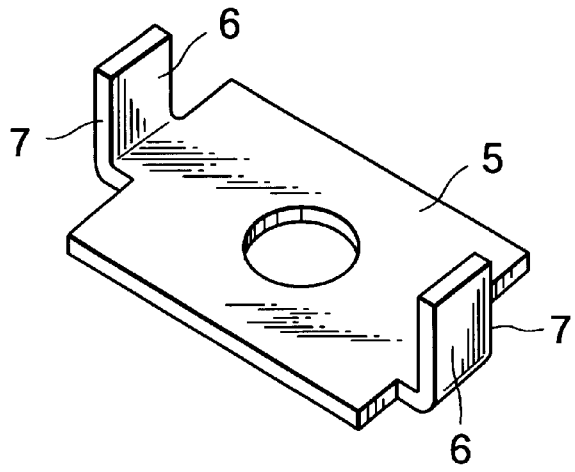
FIG. 5 is a perspective view of a crank pulley for recoil starter according to an embodiment of the present invention.

A crank pulley shown in FIG. 5 has square leg portions 6 formed symmetrically on both shorter sides of a rectangular plate body 5. One side surface of the leg portion 6 is vertical to the plate body 5 and used as an impact surface 7 against a dog 4.

Figure 6:
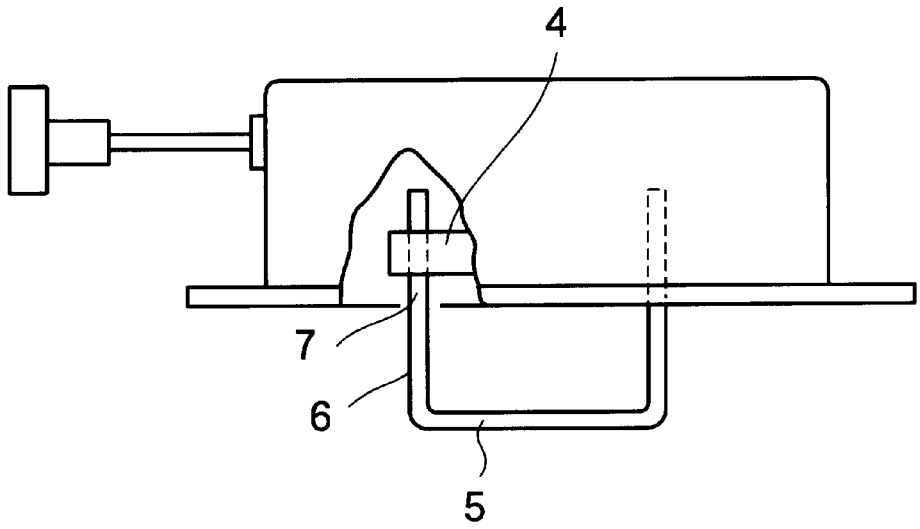
FIG. 6 is an illustration to show a situation where a crank pulley shown in FIG. 5 contacts a recoil-starting dog.

A situation where the fitted crank pulley contacts the dog 4 is typically shown in FIG. 6.

Figure 7:
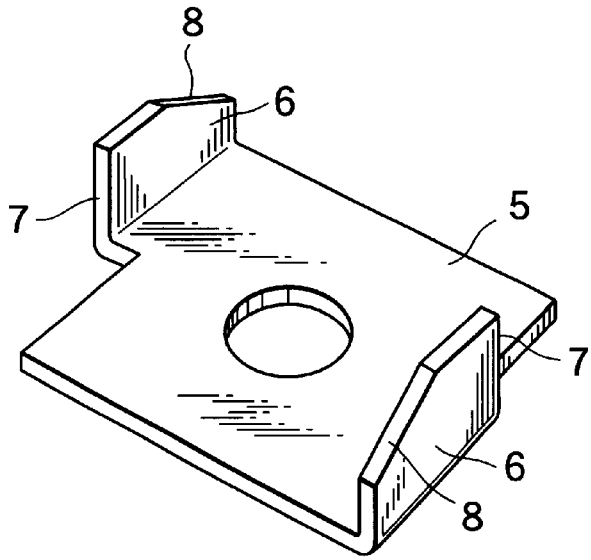
FIG. 7 is a perspective view of a crank pulley for recoil starter according to another embodiment of the present invention.

Another crank pulley shown in FIG. 7 has wider leg portions 6 in which top surface portions are partially inclined to form gradient portion 8 from impact surfaces toward the opposite ends. The gradient portion 8 of this embodiment functions to mitigate secondary shock caused by the dog when it hits the leg portion 6 after impactive contact thereof.

Figure 8:
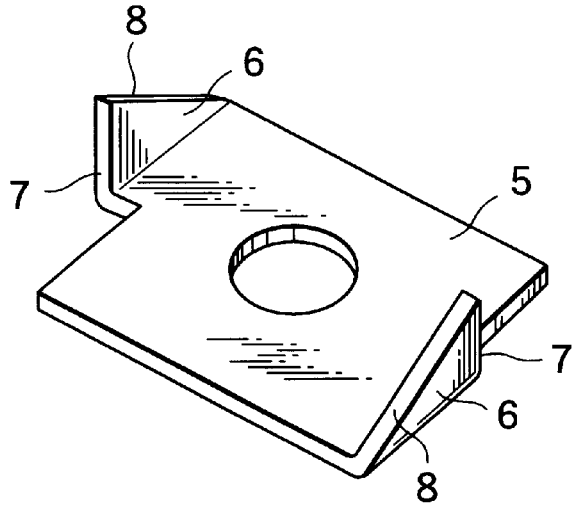
FIG. 8 is a perspective view of a crank pulley for recoil starter according to still another embodiment of the present invention.

Still another crank pulley shown in FIG. 8 is basically similar to what is shown in FIG. 7 except that top surface portions 8 are inclined as a whole to form a right-angled triangle.

Figure 9:
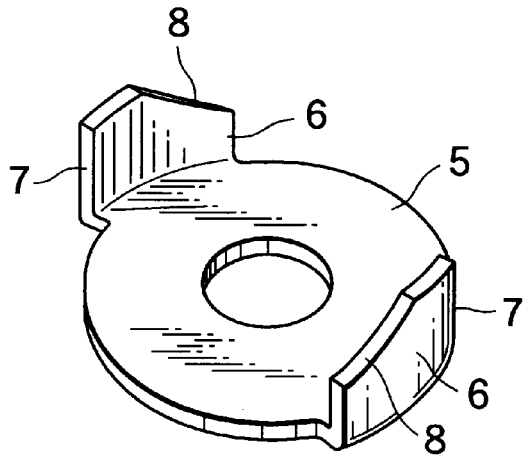
FIG. 9 is a perspective view of a crank pulley for recoil starter according to yet another embodiment of the present invention.

Yet another crank pulley shown in FIG. 9 has a round plate body 5 provided with symmetrically arranged and peripherally curved leg portions 6. Top surface portions are inclined similarly to those portions shown in FIG. 7 to form gradient portions 8. The crank pulley of this embodiment is effective to minimize a required space thereof. The leg portions 6 may be flat in shape while keeping the plate body 5 round.

Figure 10:
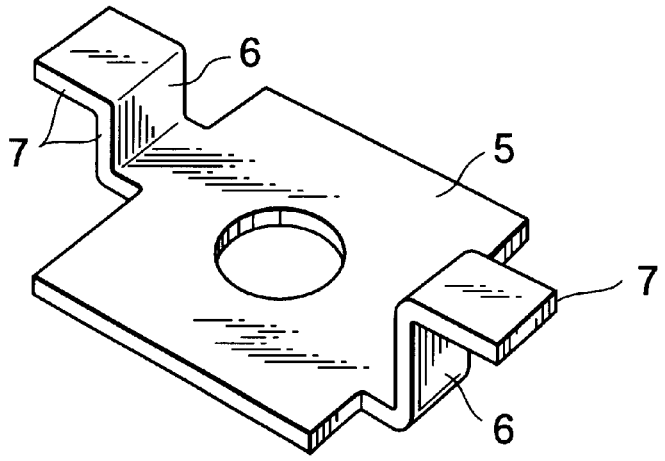
FIG. 10 is a perspective view of a crank pulley for recoil starter according to a further embodiment of the present invention.

A further crank pulley shown in FIG. 10 has leg portions 6 provided with flanges which are fitted outward of the top of leg portions 6 at an angle of nearly 90° and parallel to a plate body 5. An area of an impact surface 7 is increased because of a shape of L, which scatters impact against a dog and improves durability thereof.

Figure 11:
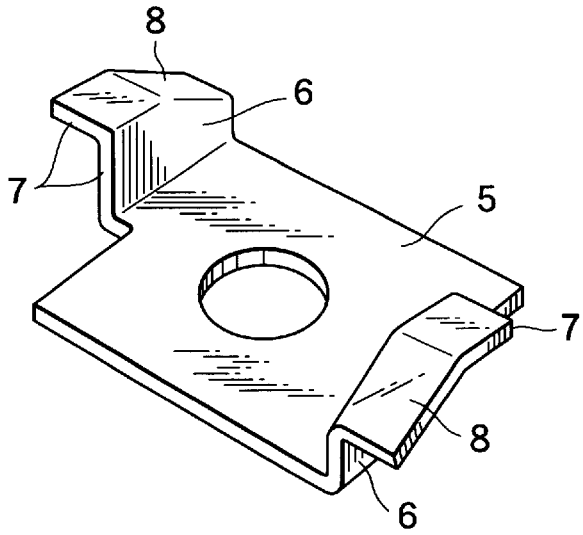
FIG. 11 is a perspective view of a crank pulley for recoil starter according to a still further embodiment of the present invention.

A still further crank pulley shown in FIG. 11 has leg portions provided with flanges which are fitted outward of the top of leg portions 6 including gradient portions 8 at an angle of nearly 90°. An area of gradient portions 8 is increased because of these flanges compared with those portions shown in FIG. 7, which mitigates the impact when a dog hits log portions after its impactive contact and effectively reduces damage thereof. In addition, wider contact surfaces 7 contribute to scattering of impact against the dog and improvement of the durability.

Figure 12:
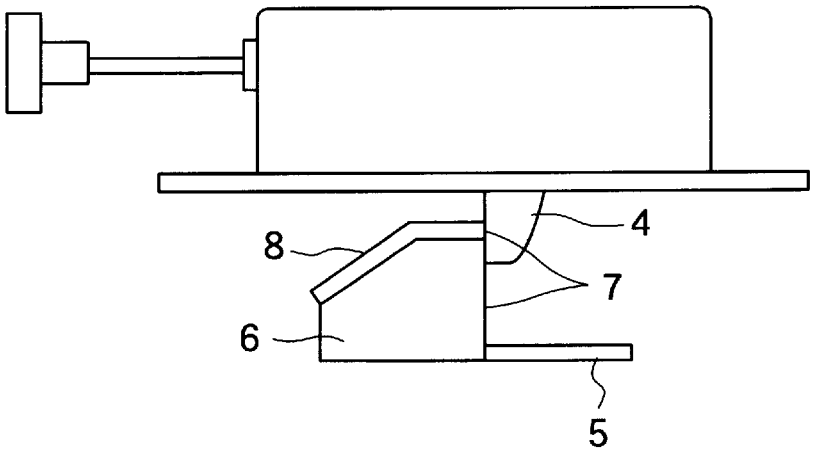
FIG. 12 is an illustration to show a situation where a crank pulley shown in FIG. 11 contacts a recoil-starting dog.

A situation where the crank pulley shown in FIG. 11 contacts the recoil-starting dog is typically shown in FIG. 12.

Figure 13:
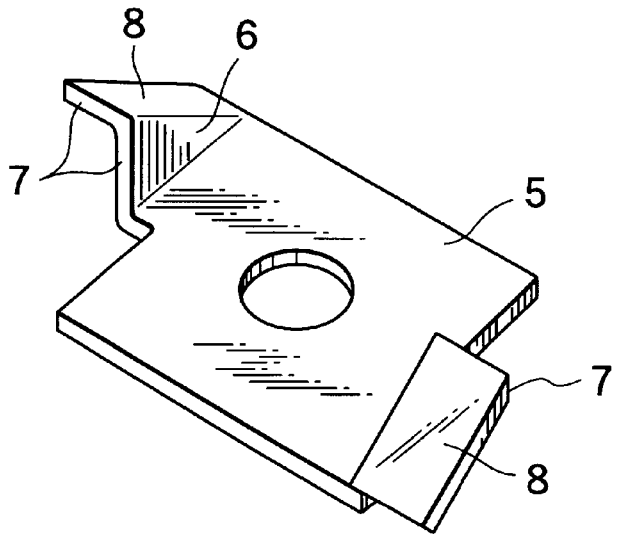
FIG. 13 is a perspective view of a crank pulley for recoil starter according to a specific embodiment of the present invention.

A specific crank pulley shown in FIG. 13 is a modification of what is shown in FIG. 8, and has leg portions 6 provided with flanges which are fitted outward of the top of the leg portions 6 nearly vertically, thereby increasing an area of gradient portions 8. An area of impact surfaces 7 against a dog is also increased because of a shape of L and, together with an increased area of gradient portions 8, exhibits similar effects as described in the crank pulley shown in FIG. 11.

Figure 14:
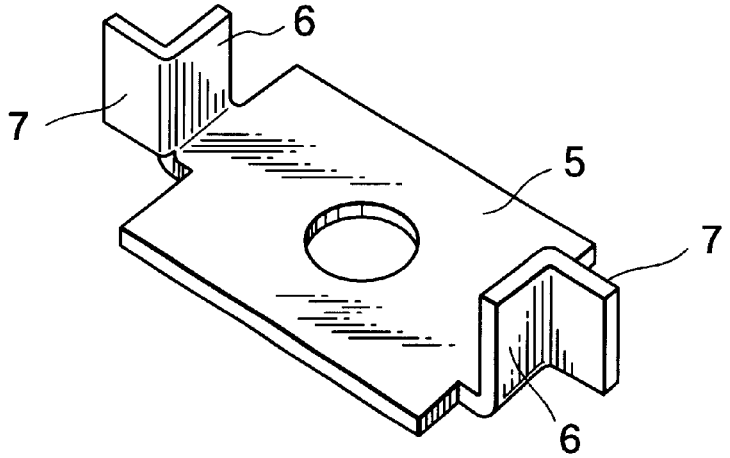
FIG. 14 is a perspective view of a crank pulley for recoil starter according to a more specific embodiment of the present invention.

A more specific crank pulley shown in FIG. 14 is a modification of what is shown in FIG. 5, and has leg portions 6 which are partially bent outward almost vertically so as to function as impact surfaces 7 against a dog. An area of the thus increased impact surfaces 7 assures impactive contact against the dog and improves the durability due to the scattered impact.

Figure 15:
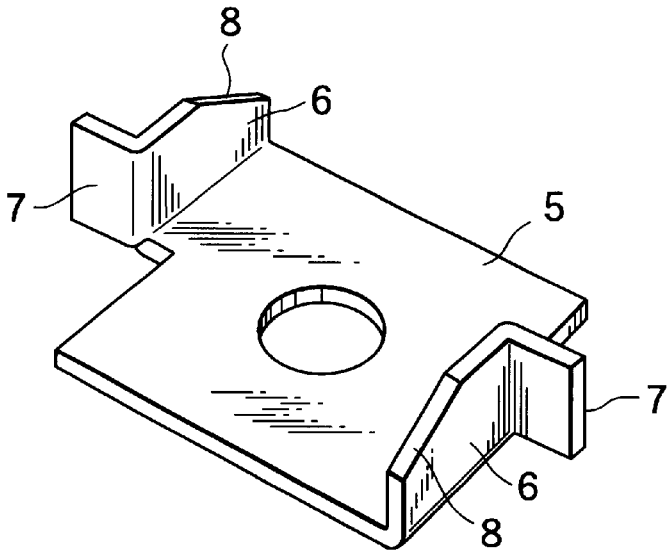
FIG. 15 is a perspective view of a crank pulley for recoil starter according to a still more specific embodiment of the present invention.

A still more specific crank pulley shown in FIG. 15 is a modification of what is shown in FIG. 7, and is provided with platelets which are fitted integrally and almost vertically to leg portions in an outward-bent situation and function as impact surfaces 7 against a dog.

Figure 16:
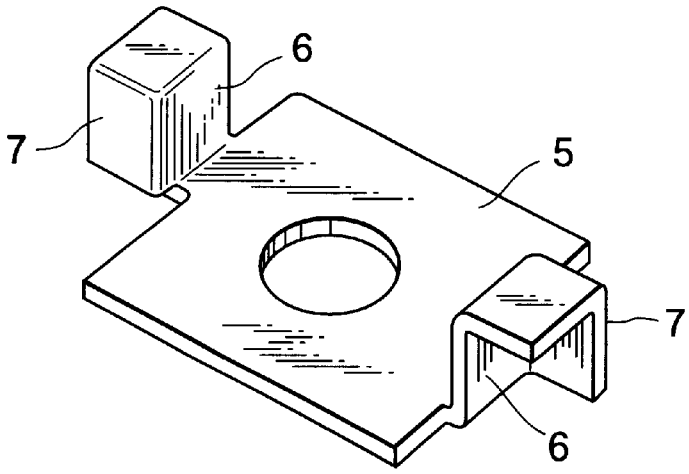
FIG. 16 is a perspective view of a crank pulley for recoil starter according to a yet more specific embodiment of the present invention.

A yet more specific crank pulley shown in FIG. 16 is a modification of what is shown in FIG. 10, and is provided with integral platelets similarly as FIG. 15 as impact surfaces 7 against a dog.

These impact surfaces 7 shown in FIGS. 15 and 16 exhibit similar effects as described above.

Figure 17:
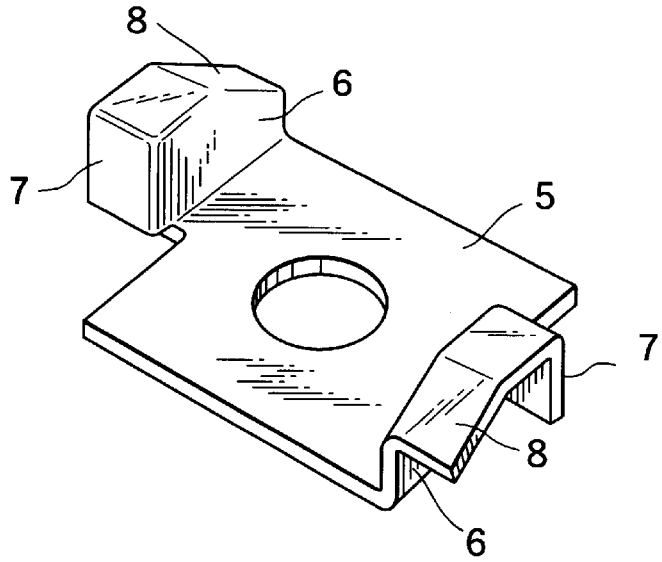
FIG. 17 is a perspective view of a crank pulley for recoil starter according to a furthermore specific embodiment of the present invention.

A still more specific crank pulley shown in FIG. 17 is a modification of what is shown in FIG. 11, and has leg portions 6 which are partially bent outward almost vertically so as to function as impact surfaces 7 against a dog, thereby exhibiting similar effects as of the crank pulley shown in FIG. 14.

Figure 18:
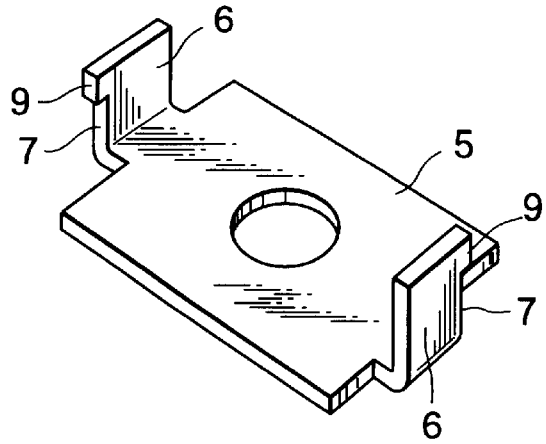
FIG. 18 is a perspective view of a crank pulley for recoil starter according to a particular embodiment of the present invention.

A particular crank pulley shown in FIG. 18 is a modification of what is shown in FIG. 5, and is provided with protruded portions 9 of predetermined length as a dog capturing tool formed on the top of impact surfaces 7.

Figure 19:
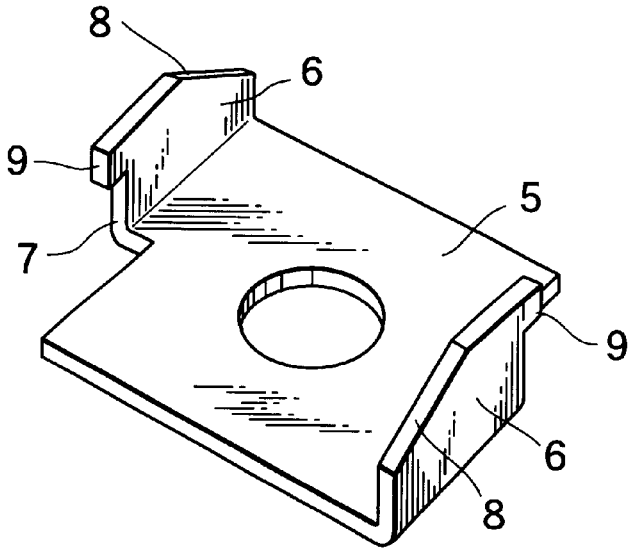
FIG. 19 is a perspective view of a crank pulley for recoil starter according to a more particular embodiment of the present invention.

A more particular crank pulley shown in FIG. 19 is a modification of what is shown in FIG. 7, and is provided with protruded portions 9 on the top of impact surfaces 7 similarly as FIG. 18.

The protruded portions 9 of the above embodiments assure impact between the crank pulley and a dog to prevent a slip-out accident thereof.

Figure 20:
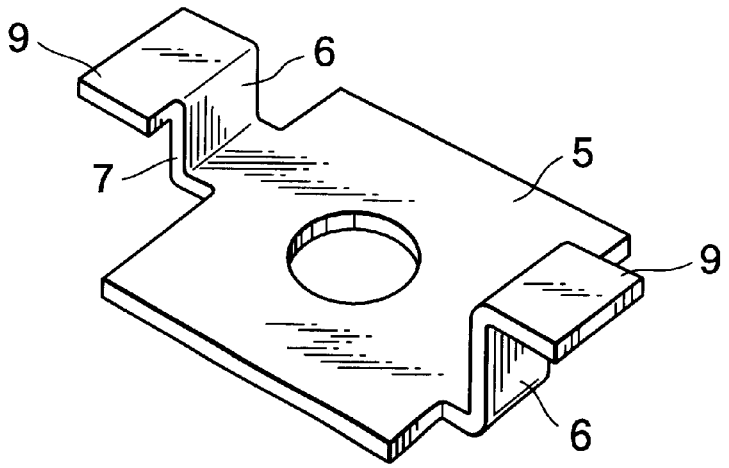
FIG. 20 is a perspective view of a crank pulley for recoil starter according to a still more particular embodiment of the present invention.

A still more particular crank pulley shown in FIG. 20 is a modification of what is shown in FIG. 10, and is provided with extended portions 9 as a dog capturing tool formed by extending flanges in the dog impact direction.

Figure 21:
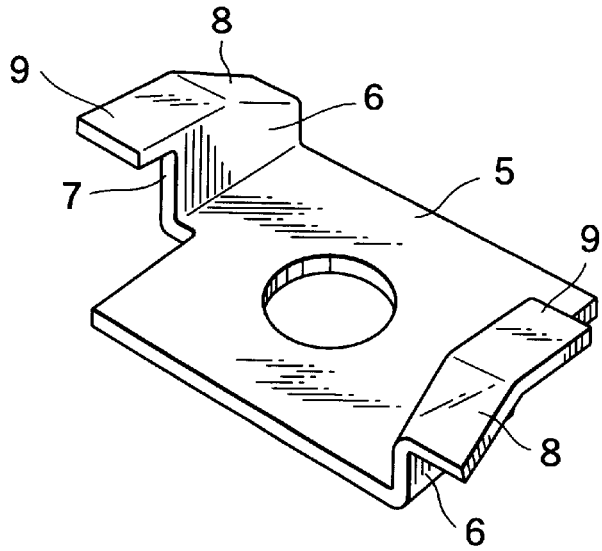
FIG. 21 is a perspective view of a crank pulley for recoil starter according to a yet more particular embodiment of the present invention.

A yet more particular crank pulley shown in FIG. 21 is a modification of what is shown in FIG. 15, and is provided with extended portions 9 as a dog capturing tool formed by extending flanges in the dog impact direction.

Figure 22:
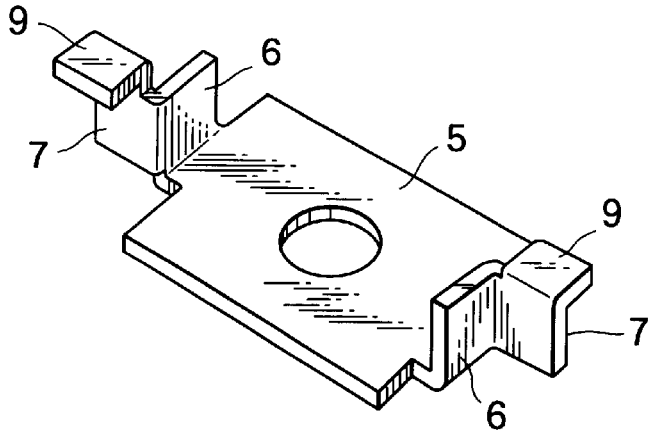
FIG. 22 is a perspective view of a crank pulley for recoil starter according to a furthermore particular embodiment of the present invention.

A more particular crank pulley shown in FIG. 22 is a modification of what is shown in FIG. 14, and is provided with protruded portions 9 of predetermined length as a dog capturing tool which extends from the top of impact surfaces 7. These protruded portions 9 successfully prevent a slip-out accident of the dog.

Figure 23:
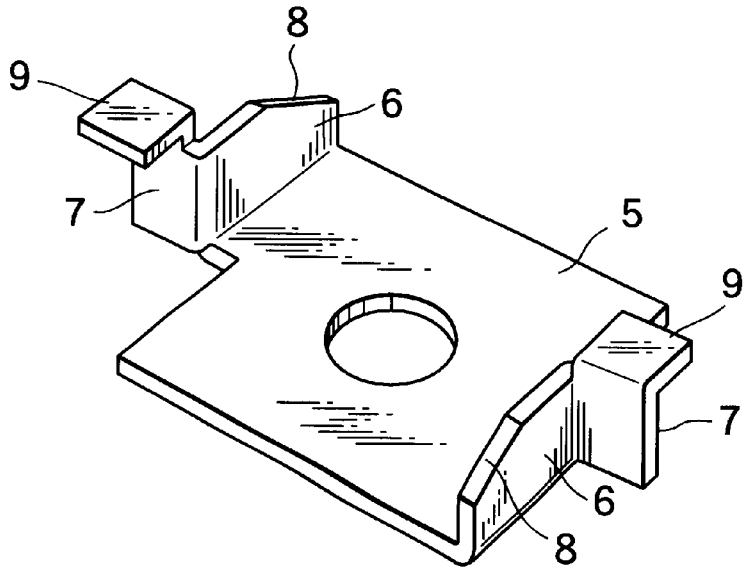
FIG. 23 is a perspective view of a crank pulley for recoil starter according to a different embodiment of the present invention.

A different crank pulley shown in FIG. 23 is a modification of what is shown in FIG. 15, and is provided with extended portions 9 as a dog capturing tool formed by extending flanges in the dog impact direction.

Figure 24:
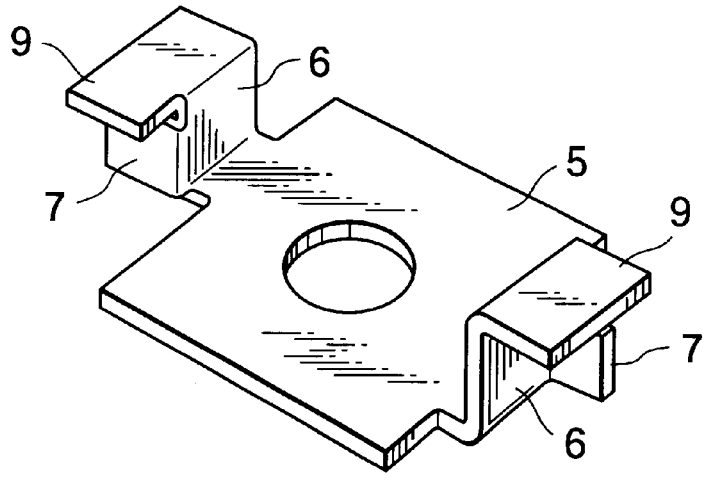
FIG. 24 is a perspective view of a crank pulley for recoil starter according to a more different embodiment of the present invention.

A more different crank pulley shown in FIG. 24 is a modification of what is shown in FIG. 16, and is provided with extended portions 9 as a dog capturing tool formed by extending flanges in the dog impact direction.

Figure 25:
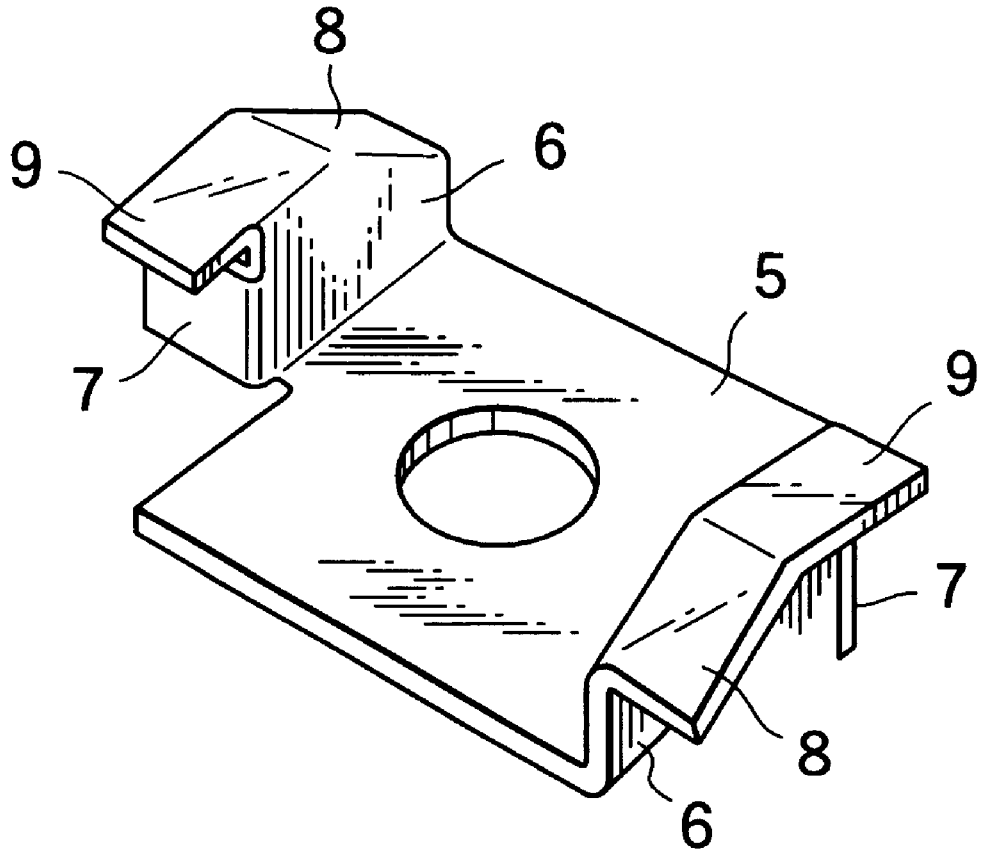
FIG. 25 is a perspective view of a crank pulley for recoil starter according to a still more different embodiment of the present invention.

A still more particular crank pulley shown in FIG. 25 is a modification of what shown in FIG. 17 and is provided with protruded portions 9 of predetermined length as a dog capturing tool which extends from the top of the impact surfaces 7. These protruded portions 9 exhibit similar effects as described above.

What is claimed is:

1. A crank pulley for a recoil starter integrally comprising a plate body, a leg portion extending substantially perpendicularly from the plate body, and an impact surface formed on one side of the leg portion and extending substantially perpendicularly to the plate body, said crank pulley being non-rotatively attached to an engine crankshaft so as to meet a recoil starter provided with a dog which moves in a direction selected from axially and radially in relation to an engine crankshaft when the recoil starter is rotated, wherein a face of said leg portion faces toward said engine crankshaft.

2. The crank pulley for a recoil starter as claimed in claim 1 wherein at least a portion of a top surface of the leg portion is inclined downward toward said plate body.

3. A crank pulley for recoil starter claimed in claim 2 wherein a dog capturing tool is formed on the top of an impact surface.

4. The crank pulley for a recoil starter as claimed in claim 2 wherein the leg portion is provided with a flange extending from the top surface of the leg portion at substantially a right angle with the leg portion and in a direction away from the engine crankshaft.

5. A crank pulley for recoil starter claimed in claim 4 wherein an impact surface is extended outward from a crank one side of a leg portion to form a flat surface.

6. A crank pulley for recoil starter claimed in claim 5 wherein a dog capturing tool is formed on the top of an impact surface.

7. A crank pulley for recoil starter claimed in claim 4 wherein a dog capturing tool is formed on the top of an impact surface.

8. A crank pulley for recoil starter claimed in claim 2 wherein an impact surface extended outward from a crank one side of a leg portion to form a flat surface.

9. A crank pulley for recoil starter claimed in claim 8 wherein a dog capturing tool is formed on the top of an impact surface.

10. A crank pulley for recoil starter claimed in claim 1 wherein a leg portion is provided with a flange fitted outward of the top surface of a leg portion at a nearly right angle.

11. A crank pulley for recoil starter claimed in claim 10 wherein a dog capturing tool is formed on the top of an impact surface.

12. A crank pulley for recoil starter claimed in claim 10 wherein an impact surface is extended outward from a crank one side of a leg portion to form a flat surface.

13. A crank pulley for recoil starter claimed in claim 12 wherein a dog capturing tool is formed on the top of an impact surface.

14. A crank pulley for recoil starter claimed in claim 1 wherein an impact surface is extended outward from one side of a leg portion to form a flat surface.

15. A crank pulley for recoil starter claimed in claim 14 wherein a dog capturing tool is formed on the top of an impact surface.

16. A crank pulley for recoil starter claimed in claim 1 wherein a dog capturing tool is formed on the top of an impact surface.

* * * * *